US009561888B2

(12) United States Patent
Nesling et al.

(10) Patent No.: US 9,561,888 B2
(45) Date of Patent: Feb. 7, 2017

(54) CAN END HAVING A MAIN SCORE AND A SCORE EXTENSION

(75) Inventors: Emily Nesling, Banbury (GB); Ezekiel Johnson, Brookfield, IL (US); Brendan Keane, Deerfield, IL (US); Jan Dvorak, Wheaton, IL (US)

(73) Assignee: Crown Packaging Technology, Inc., Alsip, IL (US)

( * ) Notice: Subject to any disclaimer, the term of this patent is extended or adjusted under 35 U.S.C. 154(b) by 1052 days.

(21) Appl. No.: 13/504,285

(22) PCT Filed: Oct. 29, 2010

(86) PCT No.: PCT/US2010/054698

§ 371 (c)(1),
(2), (4) Date: Jul. 11, 2012

(87) PCT Pub. No.: WO2011/053776

PCT Pub. Date: May 5, 2011

(65) Prior Publication Data

US 2013/0126529 A1 May 23, 2013

Related U.S. Application Data

(60) Provisional application No. 61/256,609, filed on Oct. 30, 2009.

(51) Int. Cl.
*B65D 51/16* (2006.01)
*B65D 17/00* (2006.01)
(Continued)

(52) U.S. Cl.
CPC ..... *B65D 51/1672* (2013.01); *B21D 24/00* (2013.01); *B65D 17/165* (2013.01); *B67B 7/00* (2013.01); *B65D 2517/0095* (2013.01)

(58) Field of Classification Search
CPC ... B65D 17/165; B65D 24/00; B65D 51/1672; B65D 2517/0095; B67B 7/00
(Continued)

(56) References Cited

U.S. PATENT DOCUMENTS 3,247,997 A 4/1966 Bozek
3,977,561 A 8/1976 Strobe et al.
(Continued)

FOREIGN PATENT DOCUMENTS

WO WO 00/34137 6/2000
WO WO 00/56613 9/2000
(Continued)

*Primary Examiner* — J. Gregory Pickett
*Assistant Examiner* — Brijesh V. Patel
(74) *Attorney, Agent, or Firm* — Baker & Hostetler LLP

(57) ABSTRACT

A beverage can end for seaming onto a can body may include a peripheral wall, a center panel, a tab attached to the center panel by a rivet (56), a tear panel (41*b*), a main reference line (RM), a transverse reference line (RT), and a score (31*b*). The score may include arcuate main score (31*b*) that defines a main portion of the tear panel (41*b*) and a score extension (32*b*) that defines a vent portion. The score may be configured such that actuation of the tab from its horizontal rest position to an intermediate position ruptures the main score portion (31*b*) to pivot the tear panel main portion (40*b*) about the hinge and further actuation of the tab by twisting from the intermediate position ruptures the score extension (32*b*).

11 Claims, 7 Drawing Sheets

(51) Int. Cl.
*B21D 24/00* (2006.01)
*B67B 7/00* (2006.01)

(58) Field of Classification Search
USPC ..... 220/269–273, 906; 53/492; 413/69; 222/478–479, 481, 481.5, 541.9; D9/438
See application file for complete search history.

(56) References Cited

U.S. PATENT DOCUMENTS

| | | | | |
|---|---|---|---|---|
| D297,309 | S | 8/1988 | Andersson et al. | |
| 4,901,880 | A * | 2/1990 | Tatham et al. | 220/269 |
| 5,011,037 | A | 4/1991 | Moen et al. | |
| D365,274 | S | 12/1995 | Cook | |
| 5,555,992 | A | 9/1996 | Sedgeley | |
| 5,655,678 | A * | 8/1997 | Kobayashi | 220/269 |
| 5,738,237 | A | 4/1998 | McEldowney | |
| D410,844 | S | 6/1999 | Hurst | |
| 5,964,366 | A | 10/1999 | Hurst et al. | |
| 6,065,634 | A | 5/2000 | Brifcani et al. | |
| 6,079,583 | A | 6/2000 | Chasteen | |
| D434,983 | S | 12/2000 | Hurst | |
| D448,666 | S | 10/2001 | Fields | |
| 6,354,453 | B1 | 3/2002 | Chasteen | |
| D476,889 | S | 7/2003 | Fields | |
| 6,715,629 | B2 | 4/2004 | Hartman et al. | |
| 6,761,281 | B2 * | 7/2004 | Hartman | 220/269 |
| D507,485 | S | 7/2005 | Fields | |
| 7,594,585 | B1 | 9/2009 | Fields | |
| D623,963 | S | 9/2010 | Fairchild et al. | |
| RE42,485 | E | 6/2011 | Fields | |
| 7,975,884 | B2 | 7/2011 | Mathabel et al. | |
| D715,647 | S * | 10/2014 | Jacober et al. | D9/438 |
| 2003/0080132 | A1 | 5/2003 | Forrest et al. | |
| 2008/0067175 | A1 | 3/2008 | Heinicke | |
| 2010/0166528 | A1 * | 7/2010 | McEldowney et al. | 413/16 |

FOREIGN PATENT DOCUMENTS

| | | |
|---|---|---|
| WO | WO 01/46025 | 6/2001 |
| WO | WO 2008/08892 | 1/2008 |

* cited by examiner

CAN END HAVING A MAIN SCORE AND A SCORE EXTENSION

TECHNICAL FIELD

The present invention relates to metal packaging, and more particularly to optionally vented openings in metal beverage can ends.

BACKGROUND

Aluminum beverage cans are produced in vast quantities. Conventional beverage cans include a one-piece, drawn and ironed body and an end that is attached to a flange of the can body by a double seam. A can end, in its unseamed state, has a peripheral curl for seaming to the can body flange, a wall extending from the curl (that is, a chuck wall), an annular bead (that is, a countersink), or like structure extending from the wall and a center panel.

Conventional center panels have a score that defines a tear panel and a tab that is attached to the center panel by a rivet. The score has first and second ends that define a hinge about which the tear panel actuates. In the vast majority of commercial ends, the hinge is not centered relative to the score and tear panel, but rather is located to a side. The score extends from its first end in front of the rivet about a curved path to its second end. Conventional large opening ends (LOE) have an elongated opening, as shown in FIG. 1A (Prior Art).

Commercial ends of the type shown in FIG. 1A are opened only by lifting the heel of the tab to force the tab nose against the tear panel. The downward force initiates an initial venting, which is promoted by a check slot, and the downward force then displaces the tear panel and ruptures the remainder of the score to form an opening.

Pouring from conventional beverage cans creates unsteady state flow or "glugs," as described in U.S. patent application Ser. No. 09/857,145, which is assigned to the assignee of the present invention.

U.S. Pat. Nos. 6,354,453; 6,079,583; 5,555,992; 5,011,037; and 3,977,561 disclose can ends that have been purported to create a vent after opening. There is a need for improved can end configurations that promote venting after opening of the tear panel.

SUMMARY

A beverage can end, a method of opening a beverage can end, and a system for forming a score in a beverage can end are disclosed. A beverage can end for seaming onto a can body may include a peripheral wall, a center panel, a tab attached to the center panel by a rivet, a tear panel, a main reference line, a transverse reference line, and a score. The tear panel may include (i) a main portion capable of pivoting about a hinge and (ii) a vent portion. The main reference line may bisect the tear panel main portion and may extend through the rivet, the hinge being offset relative to the main reference line. The transverse reference line may be perpendicular to the main reference line and may extend through the rivet, the main portion of the tear panel being located in front of the transverse reference line. The score may include arcuate main score that defines the main portion of the tear panel and a score extension that defines the vent portion.

Preferably, the score extension defines an arc that generally corresponds to the path of the tab when twisted in the further actuation from the intermediate position, such as a curved profile. Also, the score may be configured such that the actuation from the intermediate position is optional. Preferably, the main portion of the tear panel is elongated in a transverse direction and has an aspect ratio of between 1.3 and 1.7.

The main reference line and the transverse reference line preferably divide the center panel into first and second front quadrants and first and second rear quadrants, the score extends (i) from the score first end in the first front quadrant across to the main reference line near the rivet to extend into the second front quadrant, (ii) in an arcuate path in the second front quadrant, (iii) across the main reference line near the front-most portion of the center panel, (iv) in an arcuate path in the first front quadrant, and (v) to an intermediate point located in the first front quadrant and defining an end of the hinge opposite the score first end.

The score extension extends from the intermediate point across the transverse reference line into the first rear quadrant. The hinge is defined between the score first end and an intermediate point on the score, which is at the base of the score extension. Preferably the score extension is no longer than three times the length of the hinge, and even more preferably the score extension is no longer than two times the length of the hinge.

A first end of the score (i) may define one end of the hinge and (ii) may be located on the hinge-side of the main reference line and in front of the transverse reference line. A second end of the score (1) may define one end of the score extension and (ii) may be located on the hinge-side of the main reference line and to the rear of the transverse reference line. The score may be configured such that actuation of the tab from its horizontal rest position to an intermediate position ruptures the main score portion to pivot the tear panel main portion about the hinge, and further actuation of the tab by twisting from the intermediate position ruptures the score extension. The score extension may optionally define an arc that generally corresponds to the path of the tab when twisted in the further actuation from the intermediate position.

A method of opening a beverage can end may include the steps of providing a beverage can including a can body and an end attached to the can body by a double seam; lifting a heel of the tab from its initial, horizontal position; and twisting, after the lifting step, the tab to rupture an extension of a score. The can end may include a peripheral wall, a center panel, and a tab attached to the center panel by a rivet. The center panel may include a tear panel that is formed by a score and may define a main reference line that bisects a main portion of the tear panel. Lifting a heel of the tab from its initial, horizontal position may force a nose of the tab against the tear panel until the score ruptures and the tear panel main portion pivots about a hinge that extends from a first end of the score. The first end of the score may be located in front of the main reference line and on the hinge-side of a transverse reference line. The score may be configured such that actuation of the tab from its horizontal position to an intermediate position ruptures the main score portion to open the tear panel main portion and further actuation of the tab by twisting from the intermediate position ruptures the score extension to open the panel vent portion. The score extension may optionally define an arc that generally corresponds to the path of the tab when twisted in the further actuation from the intermediate position.

A system for forming a score in a beverage can end may include an upper score cap having a main score protrusion and a score extension protrusion and a lower score cap having an uninterrupted anvil surface extending at least to the corresponding location of the score extension protrusion of the upper score cap. The upper score cap and the lower score cap may be configured to press together such that the main score protrusion forms a main score in the beverage can end and the score extension protrusion forms a score extension in the beverage can end. The main score and the score extension may be configured such that actuation of a tab coupled to the can end from its horizontal position to an intermediate position ruptures the main score portion to open a tear panel main portion and further actuation of the tab by twisting from the intermediate position ruptures the score extension to open a panel vent portion. The score extension may optionally define an arc that generally corresponds to the path of the tab when twisted in the further actuation from the intermediate position.

These and various other advantages and features are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there are illustrated and described preferred embodiments of the invention.

DETAILED DESCRIPTION OF ILLUSTRATIVE EMBODIMENTS

Figure 1A:
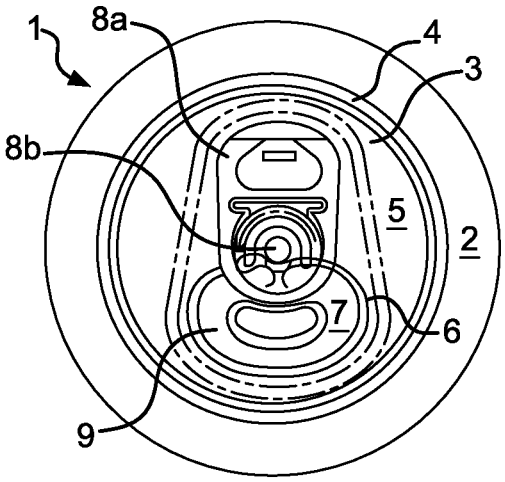
FIG. 1A (PRIOR ART)
FIG. 1A (Prior Art) is a top plan view of a conventional beverage can.

Referring to FIG. 1A (prior art), a prior art beverage can 1 includes a can body 2 and a conventional large opening end (LOE) 3. The can end 3 is attached to the can body 2 by a conventional double seam 4. The can end 3 includes a center panel 5. The center panel 5 has a score 6 that defines a tear panel 7 and a tab 8*a* that is attached to the center panel 5 by a rivet 8*b*. When the tear panel 7 is actuated, the score 6 defines an opening 9 through which the contents of the can 1 may be poured.

Figure 2:
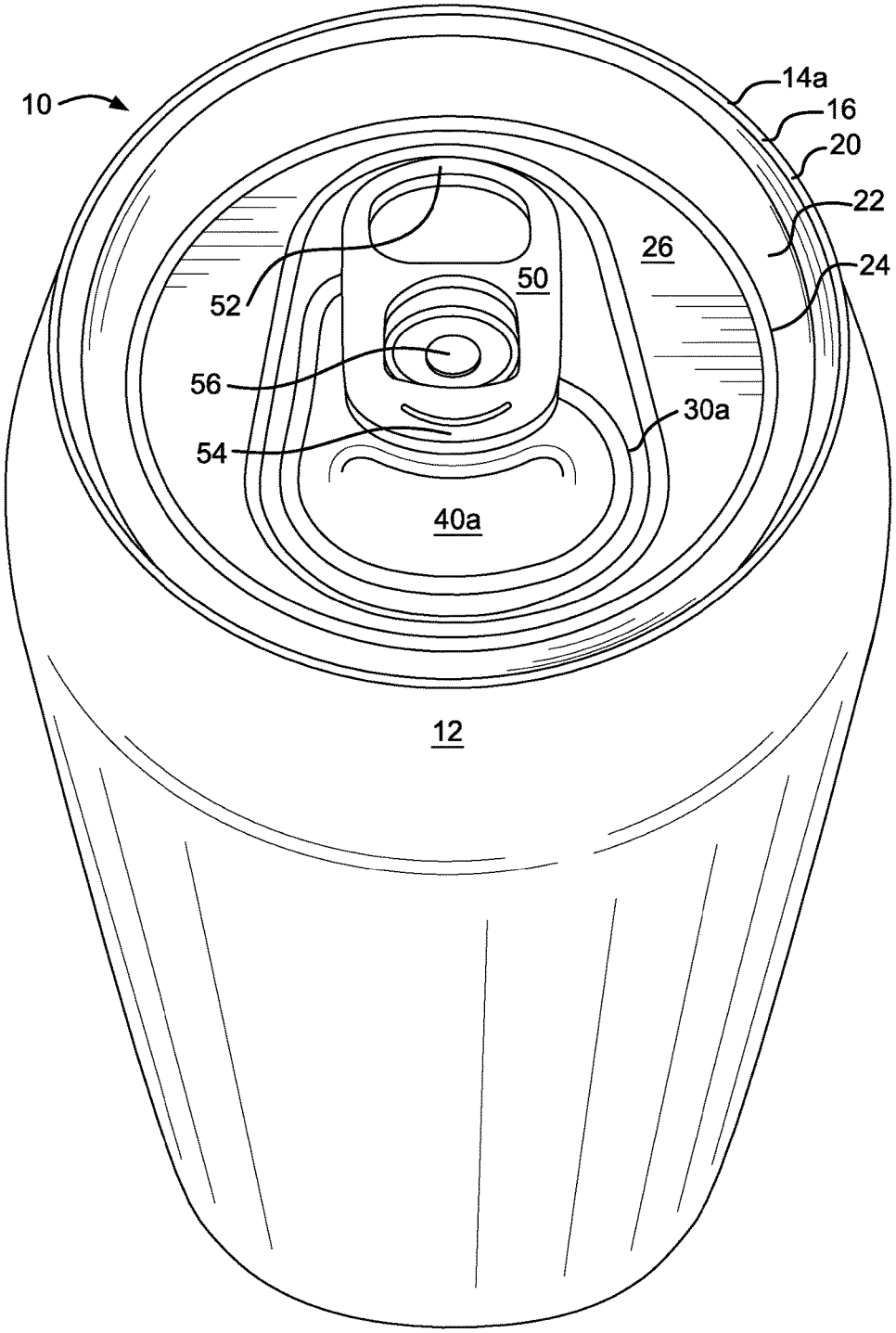
FIG. 2 is a partial perspective view of a beverage can end seemed to a can body illustrating a first embodiment of the present invention.

Referring to FIG. 2, a beverage can 10 illustrating a first embodiment of the present invention includes a can end 14*a* attached to a can body 12. The can body 12 preferably is formed of aluminum by a drawing and ironing process. The can end 14*a* shown in FIG. 2 is preferably is attached to can body 12 by a conventional double seam 16.

The can end 14*a* has a generally circular shape with a rivet 56 located at or near the center of the can end 14*a*. A chuck wall 22 extends inwardly and downwardly from seam 16 to an annular bead or countersink 24. Countersink 24 connects the center panel 26 and the chuck wall 22, extending downwardly into the chamber of the can body and away from the center panel 26. The can end 14*a* may be formed of a shell having any configuration, several of which are currently known. Reference numeral 20 in FIG. 2 is used to illustrate the position of a portion of the curl of the unseamed can end. Can end 14*a* includes a score 30*a* formed on center panel 26, as described more fully below.

Figure 3:
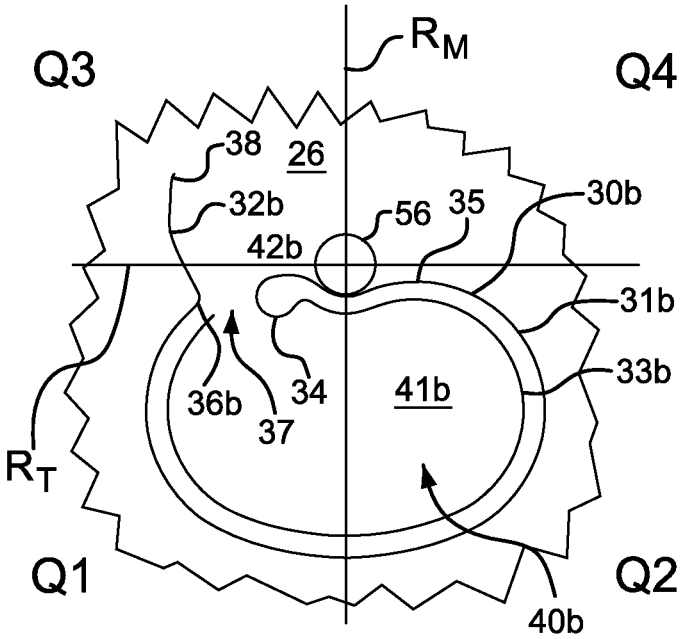
FIG. 3 is a partial cutaway top plan view of a tear panel according to a second embodiment of the present invention.

The first embodiment of the score (30*a*) is employed in FIG. 2 to illustrate the combination of the can end with the can body. FIG. 3 depicts a top view of a portion of a can end 14*b* according to a second embodiment of the present invention. End 14*b* is illustrated in its unseamed state, and it is understood that the present invention encompasses can ends that are unseamed, seamed can ends, and the combination of a seamed can end and can body.

End 14*b* includes a center panel 26 having a score 30*b*. Score 30*b* includes main score 31*b* and a score extension or vent score 32*b*, which scores define a displaceable tear panel 40*b* having a main portion 41*b* and a vent portion 42*b*. To aid in the description of the location of portions of the score 30*b*, a main reference line $R_M$ is defined as bisecting the main portion 41*b* of the tear panel 40*b* and extending through the center of the rivet 56. A transverse reference line $R_T$ is defined as perpendicular to the main reference line $R_M$ on the center panel 26 and extending through the center of the rivet 56. For tear panels having a main portion that is asymmetrical (not shown), line $R_M$ may be drawn through the rivet to divide the area of the main portion of the tear panel into equal areas. The transverse reference line $R_T$ defines the front and rear directions or locations. The side of the transverse reference line $R_T$ on which main portion 41*b* of tear panel 40*b* is located is referred to as the front of can end 14*b*, and the opposing side is referred to as the rear. The reference lines $R_M$ and $R_T$ form first and second front quadrants Q1 and Q2 and first and second rear quadrants Q3 and Q4. When the front of the can end 14*b* is depicted below the rear of the can end 14*b* as shown in FIG. 3, Quadrants Q1 and Q3 are located on the left side (also referred to as the hinge side) of the main reference line $R_M$ and quadrants Q2 and Q4 are located on the opposing right side of the main reference line $R_M$. In this way, the transverse reference line $R_T$ defines directions left and right.

The shape and location of the main score 31*b* relative to the main reference line $R_M$ and the transverse reference line $R_T$ will now be described. Main score 31*b* extends from a first end 34 of main score 31*b*, which preferably is located to the front and side of the rivet 56 in the front left quadrant Q1. Main score 31*b* extends across main reference line $R_M$ near and in front of the rivet 56 into front right quadrant Q2 in an arcuate path. A check slot 35, which temporarily stops or inhibits the opening of the main score 31*b* near the rivet 56 to allow for initial venting of the beverage can 10, may be located in the main score 31*b* near the rivet 56. Accordingly, a portion of score 31*b* near end 34 functions as a conventional vent.

Past the check slot 35, the main score 31*b* continues in an arcuate path through Q2, the extent of which defines a side of the main portion 41*b* of the tear panel 40*b*, and again crosses the main reference line $R_M$ and into the front left quadrant Q1 near the chuck wall 22 and near the front-most portion of the center panel 26. In the embodiment shown in FIG. 3, the main score 31*b* continues from the front of center panel 26 through the front left quadrant Q1 in an arcuate path until the main score 31*b* approaches and extends to an intermediate point 36*b*. Preferably, intermediate point 36*b* is located in the front left quadrant Q1 on the front side of the transverse reference line $R_T$ and on the same side of the main reference line $R_M$ as the score first end 34. Because main score 31*b* extends toward main reference line $R_M$ after forming the left-most portion of main panel portion 41*b*, and score extension 31*b* extends from intermediate point 36*b* on a curved path that has a leftward component (as viewed in FIG. 4A), intermediate point 36*b* is formed on a peninsula-like protrusion that forms a point and roughly triangular shape.

A hinge 37 is defined between the score first end 34 and the intermediate point 36*b*. Hinge 37 defines the boundary of main portion 41*b* of tear panel 40*b* and defines the structure about which the main portion 41*b* of the tear panel 40*b* pivots when the tear panel 40*b* is opened. In the first, second, and third embodiments shown in FIGS. 2 through 5B, the hinge 37 is located on the front side of the transverse reference line $R_T$ and on the hinge side (also the left side in the figures) of the main reference line $R_M$ in quadrant Q1. While hinge 37 has been described in relation to the first end 34 and the intermediate point 36*b* of the second embodiment, it will be appreciated that in the first and third embodiments, the hinge 37 extends from the first end 34 to the intermediate points 36*a,c*, respectively.

Again referring to FIG. 3, a score extension 32*b* extends from intermediate point 36*b*. Score extension 32*b* extends towards the rear of the can end 14*b* from the intermediate point 36*b* past the transverse reference line $R_T$ and into the rear left quadrant Q3, without crossing the main reference line $R_M$, to terminate at a second end 38 of the score 31*b*. As shown, the score extension 32*b* may have a hook-shape or curvature.

FIG. 3 also shows an anti-fracture score 33*b* extending along the main score 31*b*. The anti-fracture score 33*b* preferably extends along main score 31*b* and/or the score extension 32*b* and is offset from the main score 31*b* and/or the score extension 32*b*. All scores described herein may be formed by conventional methods. Preferably, the main portion 41 of tear panel 40 has the dimensions of conventional large opening ends configured as well-known DRT or Stolle-style configurations.

Figure 4C:
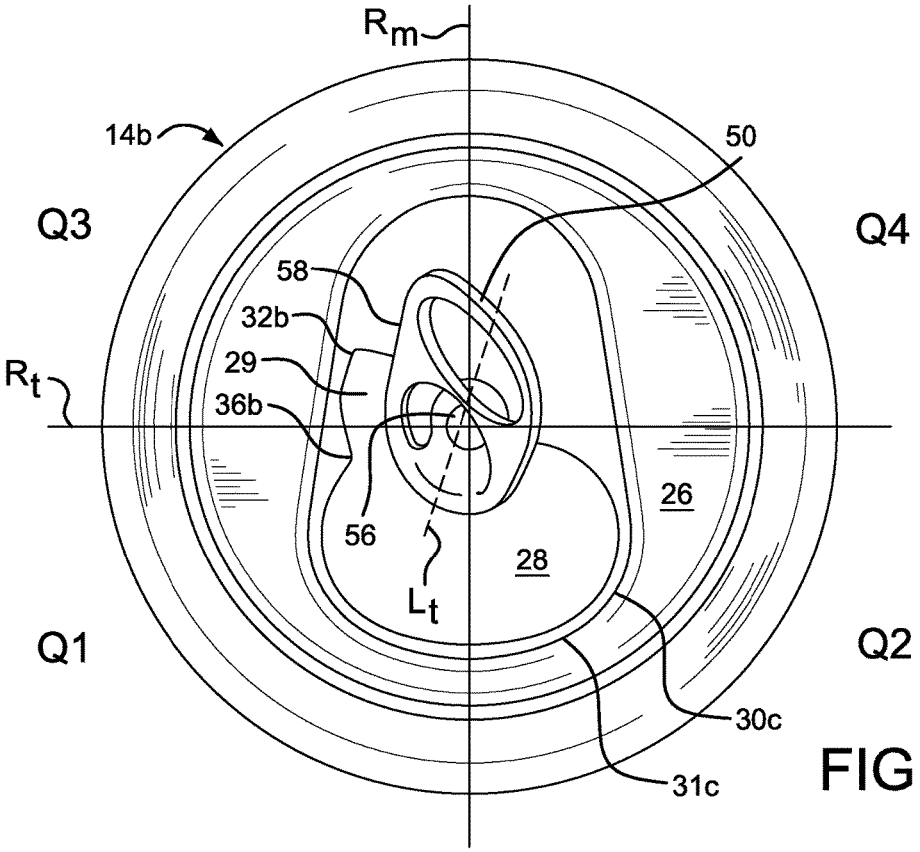
FIG. 4C is a top plan view of the end of FIG. 4A in a fully actuated, vented state.
Figure 4A:
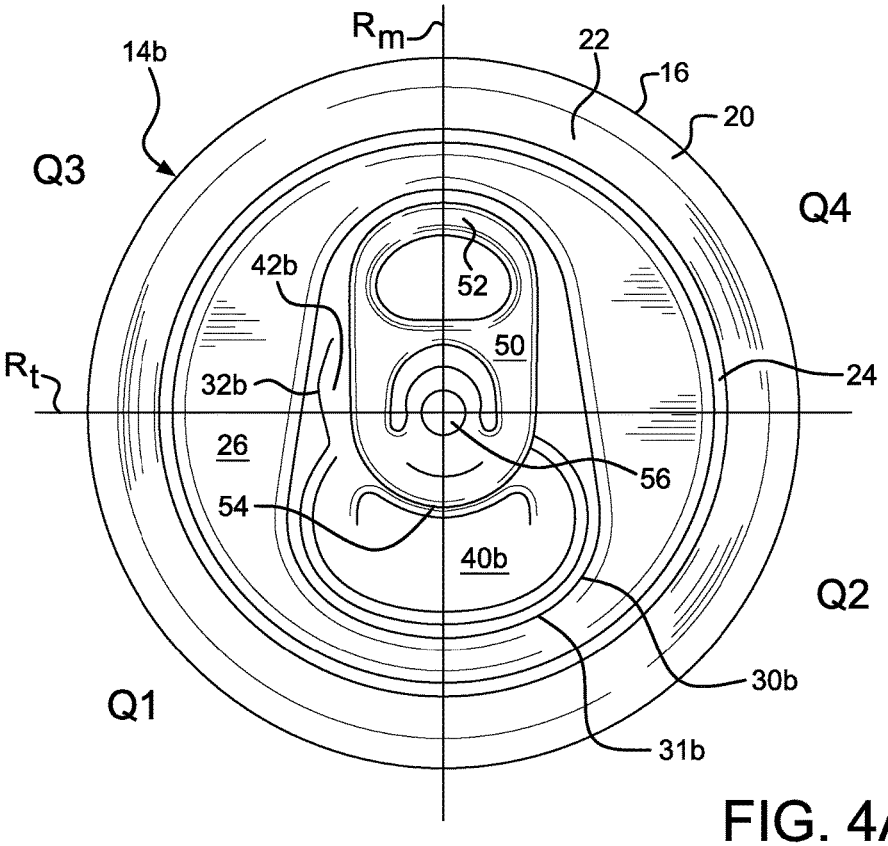
FIG. 4A is a top plan view of a an unseamed beverage can end in an unactuated state according to the second embodiment of the present invention.

FIG. 4A shows combination can body 12 and can end 14 with the score configuration of FIG. 3. A tab 50 for opening the tear panel 40*b* is attached to the center panel 26 by rivet 56. Tab 50 includes a heel 52 at its rear end and a nose 54 at its front end. When the tear panel 40*b* is actuated, score 30*b* defines a portion of the main opening 28 (shown in FIG. 4B) through which the contents of the can 10 may be poured, and at least a portion of a vent opening 29 (shown in FIG. 4C) through which air can flow into the can 10 to allow for faster and smoother pouring of a beverage through the main opening 28. Hinge 37 defines another portion of the boundary of main opening 28.

As shown in FIGS. 3, 4A, 4B, and 4C, score extension 32*b* preferably is curved to approximately follow an arc defined by the actuation of tab 50, as explained more fully below. In this regard, the score extension 32*b* may have a radius that is approximately equal to or slightly larger than the radius of the arcuate path of the leading edge 58 (best shown in FIG. 4C) of the tab 50. For example, the score extension 32*b* may be formed of a single or gradually changing arcs that are no greater than about 130% of the radius of the arc of tab actuation, preferably no greater than about 120%, more preferably less than about 110% of the radius of the arc of tab actuation. In this regard, the arc of the tab actuation may be defined as the movement in space of the outermost portion of tab 50 as its is twisted from its intermediate position of FIG. 4B to its actuated position of FIG. 4C. The arc preferably is defined in the plane of center panel 26. Also, score extension 32*b* preferably is no longer than three times the length of the hinge, and more preferably no longer than two time the length of the hinge. The present invention is encompasses other shapes of the score extension.

Figure 5A:
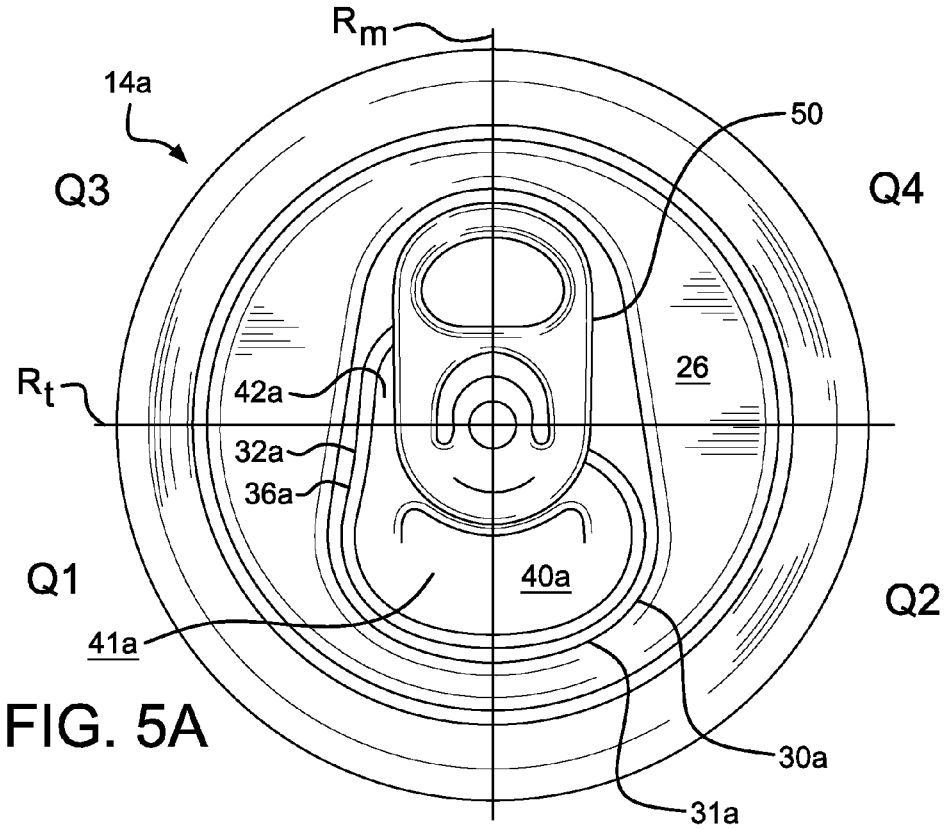
FIG. 5A is a top plan view of a beverage can end according to the first embodiment of the present invention.

FIG. 5A illustrates a first embodiment of the score 30*a* (shown in FIG. 2). First embodiment score 30*a* includes a main score 31*a* and a score extension 32*a*, both formed in the center panel 26. Scores 31*a* and 32*a* define a displaceable tear panel 40*a* having a main portion 41*a* and a vent portion 42*a*. Tab 50 is attached to center panel 26 by rivet 56. The description of main portion 41*a* and tear panel 40*a* is the same as that for second embodiment main panel portion 41*b*. Second embodiment score extension 32*a* extends from an intermediate point 36*a* on the score.

First embodiment main score 31*a* is as described for second embodiment main score 31*b* with respect to its shape from end 34 (not shown in FIG. 5A because end 34 is below tab 50) through quadrant Q2. Main score 31*a* extends from quadrant Q2 in its arcuate path through quadrant Q1 to define the left-most part of main panel portion 41*a*. Main score 31*a* extends around the leftward-most part of main panel portion 41*a* and extends rearward, then extends rearwardly and rightwardly with only a slight inward curvature (that is, convex when viewed from the hinge-side of the end). Intermediate point 36*a* is formed on the inwardly bowed portion of the score. In embodiments in which the location of the intermediate point it is unclear from the shape of the score, the intermediate point may be defined as the portion of the score the forms the end of the hinge opposite end 34. Intermediate point 36*a* preferably is in quadrant Q1—forward of transverse line $R_T$ and on the left or hinge side of main reference line $R_M$.

Score extension 32*a* extends towards the rear of the can end 14*a* from the intermediate point 36*a* past the transverse reference line $R_T$ and into the rear left quadrant Q3, without crossing the main reference line $R_M$. Score extension 32*a* terminates at a second end 38 of the score 30*a*. As shown, the score extension 32*a* may have a hook-shape or curvature that extends inwardly toward main reference line $R_M$. Preferably, score extension 32*a* has an arcuate shape as described above with respect to second embodiment score extension 32*b*.

Preferably, the upper portion (that is, distal from intermediate point 36*a*) has curvature and dimensional relationships that are as described for second embodiment score extension 32*b*, such that (for example) the tail portion of score extension 32*a* has a radius that is approximately equal to or slightly larger than the radius of the arcuate path of the leading edge 58 of the tab 50, and a length as described above.

Figure 5B:
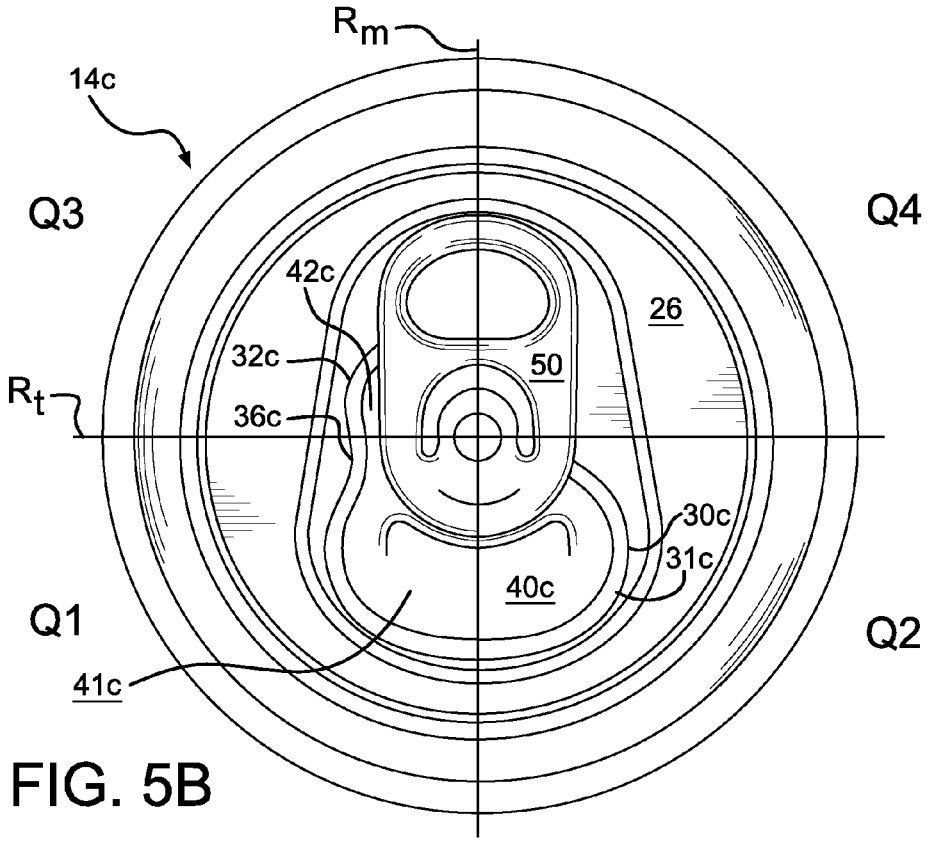
FIG. 5B is a top plan view of a beverage can end according to a third embodiment of the present invention.

FIG. 5B depicts a third embodiment of the score 30*c* on a can end 14*c*. Third embodiment score 30*c* includes a main score 31*c* and a score extension 32*c* and is formed in the center panel 26. Main score 31*c* and score extension 32*c* define a displaceable tear panel 40*c* having a main portion 41*c* and a vent portion 42*c*. Tab 50 is attached to center panel 26 by a rivet 56. The description of main portion 41*a* tear panel 40*a* is the same as that for second embodiment main panel portion 41*b* except for intermediate point 36*c* and the portion of score 31*c* near intermediate point 36*c*. Third embodiment score extension 32*c* extends from an intermediate point 36*c* on the score.

Third embodiment main score 31*c* is as described for second embodiment main score 31*b* with respect to its shape from end 34 (not shown in FIG. 5B because end 34 is below tab 50) through quadrant Q2. Main score 31*c* extends from quadrant Q2 in its arcuate path through quadrant Q1 to define the left-most part of main panel portion 41*c*. Main score 31*c* extends around the leftward-most part of main panel portion 41*c* and extends rearward, then extends rearwardly and rightwardly with an inward curvature (that is, convex when viewed from the hinge-side of the end) to form a waist. Intermediate point 36*c* is formed on the inwardly bowed portion or waist portion of the score. Intermediate point 36*c* preferably is in quadrant Q1—forward of transverse line $R_T$ and on the left or hinge side of main reference line $R_M$.

Score extension 32*c*, from intermediate point 36*c*, extends away from main reference line $R_M$ and toward the rear of the can end 14*c*, thereby forming a protruding portion of the center panel and the waist on which intermediate point 36*c* is defined. Score extension 32*c* continues to extend past the transverse reference line $R_T$ and into the rear left quadrant Q3, without crossing the main reference line $R_M$. Score extension 32*c* terminates at a second end 38 of the score 30*c*. As shown, the score extension 32*c* has a hook-shape or curvature that extends inwardly toward main reference line $R_M$. Preferably, score extension 32*c* has an arcuate shape as described above with respect to second embodiment score extension 32*c*.

Preferably, the curvature of the upper portion of score extension 32*c* (that is, distal from intermediate point 36*c*) has curvature and dimensional relationships that are as described for second embodiment score extension 32*b*, such that (for example) the tail portion of score extension 32*c* has a radius that is approximately equal to or slightly larger than the radius of the arcuate path of the leading edge 58 of the tab 50, and a length as described above.

The main scores 31*a,b,c* of the three embodiments shown in FIGS. 2 through 5B (the use of more than one reference letter after a reference numeral will be used in the description to indicate that the text refers to the embodiments corresponding to the reference letters) may have the same depth and cross-sectional shape as the score 6 in a conventional large opening end 3 (shown in FIG. 1A). For example, the score residual for the main score 31*b* may be approximately 0.0034 to 0.0043 inches. Alternatively, the three embodiments of the main score 31*a,b,c* may have a thicker score residual than the score 6 in a conventional large opening end 3 (e.g., for increased score strength).

In the embodiments shown in figures, all of the main scores 31*a,b,c* and the main portions 41*a,b,c* of the tear panels 40*a,b,c* do not extend rearward of the transverse reference line $R_T$. The present invention is not limited to such structure, but rather the claims provide the full measure of the scope of the present invention.

The score extensions 32*a,b,c* preferably have the same depth and cross-sectional shape as the main score 31*a,b,c*. In some embodiments, including for example, when it is desired to increase the pressure at which the score 30*a,b,c* bursts, the score extensions 32*a,b,c* may have a thicker score residual than main score 31*a,b,c*.

The score 30*a,b,c* may include a second conventional check slot at or near the intermediate point 36*a,b,c* to help strengthen the main score 31*a,b,c* and/or the score extension 32*a,b,c*, which may enhance (that is, enable higher) the internal pressure performance or rating of the can. The score 30 may include a gap (not shown) at or near the intermediate point 36 to help strengthen the main score 31 and/or the score extension 32 for enhancing pressure performance or rating. The gap preferably is a portion of center panel 26 that has its full thickness such that portions of the score are space apart.

Figure 4B:
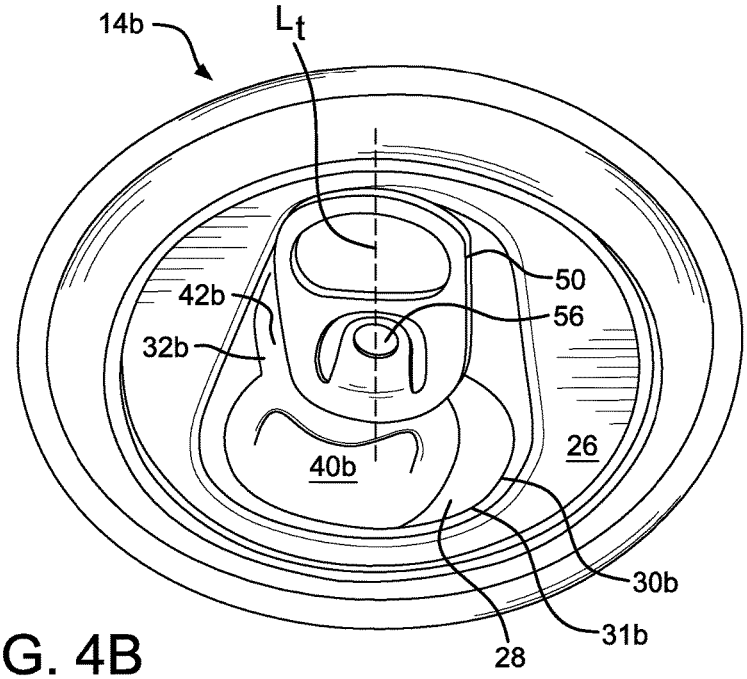
FIG. 4B is a perspective view of the end of FIG. 4A in a partially actuated state.

To describe the operation of the can ends described herein, and to explain the method steps according to an aspect of the present invention, FIGS. 4A, 4B, and 4C illustrate the opening and venting function of end 14*b*. While FIGS. 4A through 4C illustrate the second embodiment end 14*b*, the description of the opening and venting process provided in the description also applies to the opening and venting of the first embodiment (shown in FIGS. 2 and 5A) and the third embodiment (shown in FIG. 5B). Accordingly, starting with the can end 14*b* in an un-actuated, at-rest state, in which score 30*b* is intact and tab 50 is approximately parallel to a plane defined by center panel 26 or the upper rim of double seam 16, as shown in FIG. 4A, an end user begins the opening process by lifting the tab heel 52. In response, the tab 50 pivots about rivet 56 and induces deflection of the rivet 56 to force tab nose 54 against the main panel portion 41*b* when the tab is inclined approximately 20 degrees from the horizontal.

Most scores are configured such that main score 31*b* ruptures first in a short region near the rivet 56 and near first score end 34, and check slot 35 temporarily stops or slows propagation of the rupture of main score 31*b*. As the end user continues to lift tab heel 52, the force applied by the nose 54 against the main panel portion 41*b* increases until the rupture of the main score 31*b* begins (or check slot 35 is overcome, which occurs typically when tab 50 is inclined at approximately 70° relative to the center panel 26 or the rim of seam 16 or the horizontal) and then the rupture of the main score 31*b* propagates about the main portion 41*b* of the tear panel 40*b* until score propagation stops at or near intermediate point 36*b*.

FIG. 4B depicts can end 14*b* in a partially actuated state, upon completion of the first stage of opening of the score 30*b*. The main portion 41*b* of the tear panel 40*b* has pivoted about the hinge 37 to form the main opening 28. Tab 50 is generally upright such that tab 50 is oriented approximately 90° from its rest position and relative to center panel 26 or the rim of seam 16. A horizontal line $L_T$ in the plane defined by the tab 50, running the length of the center of the tab, is approximately perpendicular to the transverse reference line $R_T$.

After the can end 14*b* has been positioned in the partially actuated state shown in FIG. 4B, a user may pour a beverage through the main opening 28 in the conventional way. If a user is does not understand or appreciate the additional venting structure 42*b* and how to actuate the second stage of the opening process, or desires not to use the additional venting structure or capabilities, the user need do nothing more except pushing heel 52 back to its at-rest position. Thus, the user may use end 14*b* in a conventional way, thereby ignoring the additional venting capabilities of the can end 14*b*. Alternatively, the user may (optionally) perform additional actuation of the tab 50 to open a vent opening 29 for faster and smoother pouring of a beverage through the main opening 28. Opening the vent opening 29 may allow a user to pour a beverage through the main opening 28 more quickly, in many embodiment approximately twice as quickly, compared with leaving the vent opening 29 closed.

FIG. 4C depicts the can end 14*b* in a fully actuated, vented state. To perform the second opening stage to get end 14*b* to its fully actuated state, a user grasps and twists the tab heel 52 to create a moment about the horizontal line $L_T$. In the orientation of the Figures, the user pivots tab 50 clockwise (roughly) about the horizontal line $L_T$ to rupture score extension 32. More specifically, the leading edge of the tab 50 engages the vent portion 42*b* of the tear panel 40*b* initially at or near the hinge 37 under moment from the user's twisting until the score extension 32*b* ruptures at or near the intermediate point 36*b*. The rupture then propagates along the score extension 32*b* toward the second end 38 of the score 30*b*.

The displacement of the vent portion 42 from the plane of the center panel 26 to create the vent opening 29 provides venting (an opening through which air can flow into can 10) during pouring of a beverage through the main opening 28, which may reduce "glugging" and which may provide relatively smooth flow or diminish the magnitude of flow rate variations of the unsteady state flow of a beverage through the main opening 28.

Figure 1B:
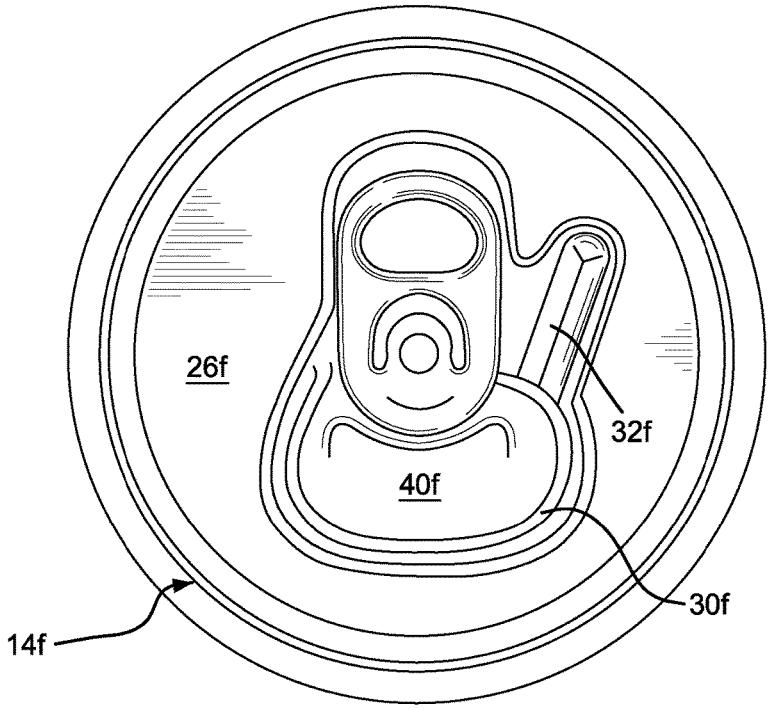
FIG. 1B (PRIOR ART)
FIG. 1B (Prior Art) is a top plan view of a beverage can end including a conventional large opening end and a venting structure.

Referring to FIG. 1B (prior art), a prior art can end 14*f* includes a circular center panel 26*f*. A score 30*f* and a vent channel 32*f* are formed in center panel 26*f*, and the score 30*f* defines a displaceable tear panel 40*f*. The can end 14*f* is produced by Ball Corporation for Coors Brewing Company.

Figure 6A:
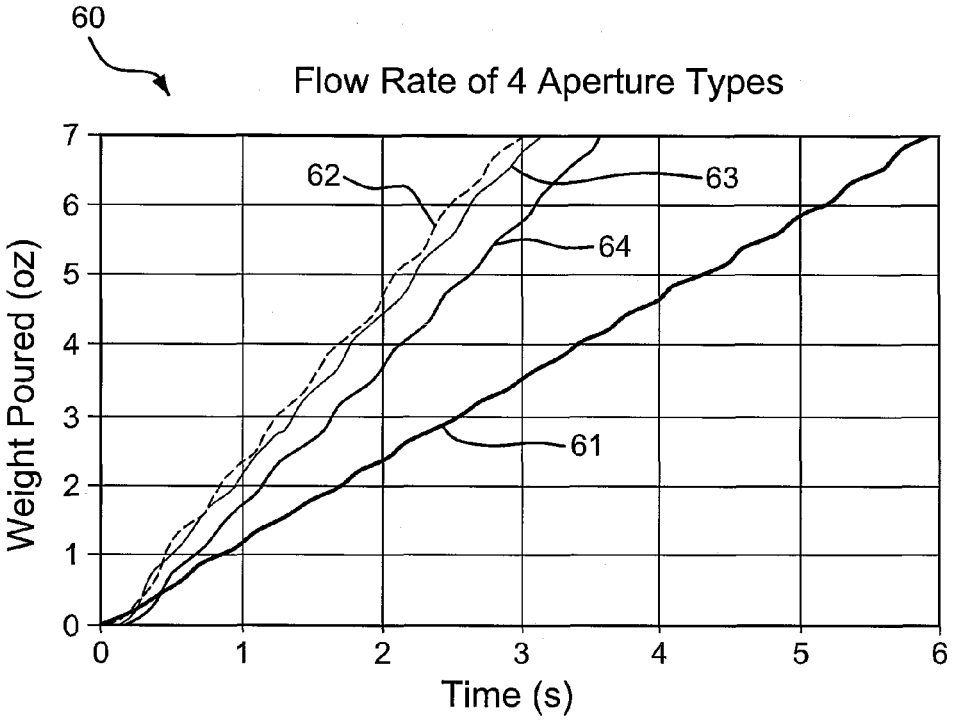
FIG. 6A is a graph showing the flow rate of four different can end designs, each having a different-shaped score design.

Referring to FIG. 6A, a graph 60 shows the weight of liquid poured from various can ends over time during an initial flow rate period (that is, after which the flow rate slows down once most of the liquid has already poured out of the can). The four score shapes tested to produce graph 60 are score 6 (FIG. 1A, Prior Art), score 30*a* (FIG. 5A), score 30*c* (FIG. 5B), and score 30*f* (FIG. 1B, Prior Art), which are shown respectively as lines 61, 62, 63, and 64. The weight of liquid poured over time out of each of the can ends shows a comparison of these four score shapes in terms of which shapes allow the fastest peak pouring of liquid through the can end.

As can be seen in graph 60, lines 62 and 63 (representing inventive scores 30*a* and 30*c*, respectively) had the highest flow rates. Line 64 (representing score 300 and line 61 (representing score 6) had lower flow rates. Comparing the performance of the different score shapes and venting structures, it can be seen from the graph 60 that the two lift-and-twist score embodiments 30*a* and 30*c* had substantially faster flow rate performance than the conventional large opening end score 6 and the conventional large opening end score 30*f* with a vent channel. The average flow rates and projected time to pour 12 oz (at a constant flow rate) that can be calculated from graph 60 are shown below in TABLE 1.

TABLE 1

| Type of Score | Average Flow Rate (oz/s) | Projected Time to Pour 12 oz (s) | % Flow Rate Improvement over LOE |
|---|---|---|---|
| LOE (Prior Art) | 1.2 | 10.4 | — |
| LOE w/ Prior Art Channel | 2.0 | 6.1 | 69% |
| Lift-and-Twist 30c | 2.3 | 5.3 | 97% |
| Lift-and-Twist 30a | 2.4 | 5.0 | 106% |

Figure 6B:
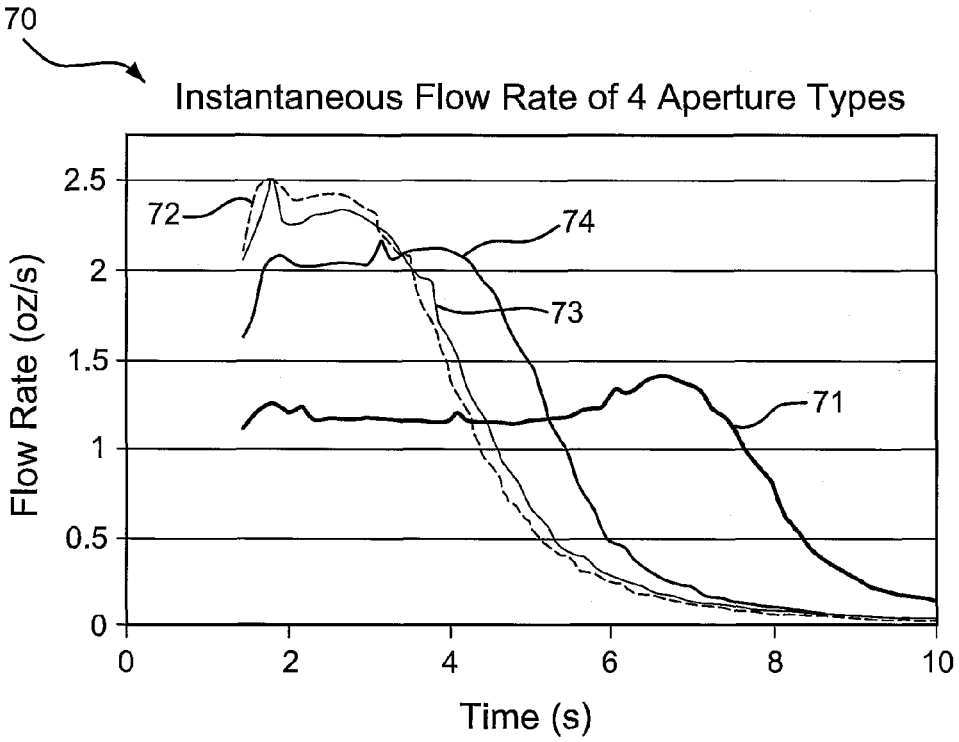
FIG. 6B is a graph showing a running average of the instantaneous flow rate of the four different can end designs depicted in FIG. 6A.

Referring to FIG. 6B, a graph 70 shows the flow rate of liquid poured from a can end openings versus time. Each point on graph 70 shows the average flow rate of liquid poured during the previous 1.5 seconds such that graph 70 represents a running 1.5-second average flow rate of liquid poured. The initial portion of graph 70 correlates to the slope of the curves shown in graph 60, but graphs 70 shows data over a longer period.

The four score shapes tested to produce graph 70 are the same four score shapes tested to produce graph 60, which are: prior art score 6 (FIG. 1A), score 30*a* (FIG. 5A), score 30*c* (FIG. 5B), and prior art score 30*f* (FIG. 1B), which are shown respectively as lines 71, 72, 73, and 74. The flow rate of liquid poured out of each of the can ends can allow a comparison of which score shapes and venting structures allow the fastest total pouring of liquid through the can end.

As can be seen in the graph 70, lines 72 and 73 (representing scores 30*a* and 30*c*, respectively) had the highest initial running average flow rates. Line 74 (representing prior art score 30*f*) and line 71 (representing prior art score 6) had lower initial flow rates. Comparing the performance of the different score shapes and venting structures, it can be seen from the graph 70 that the inventors' two lift-and-twist score embodiments 30*a* and 30*c* had substantially faster initial running average flow rate performance than the conventional LOE score 6 and the conventional LOE score 30*f* with a vent channel. Although the running average flow rates of lines 72 and 73 (corresponding to embodiments of the present invention) dropped below that of lines 71 and 74 (prior art LOE scores) at approximately 4 seconds, this is because by 4 seconds, most of the liquid has already been poured out of scores 30*a* and 30*c*, so the last ounce or two of liquid pours out at a slower rate.

To understand how quickly the 12-oz volume is poured out of the various score types, the area under each of the curves 71-74 can be calculated. As can be seen from graph 70, the area under curves 72 and 73 are farthest to the left of graph 70, which means that the volume is poured out of scores 30*a* and 30*c* at an earlier point in time compared to the LOE scores. It can be seen from graph 70 that curves 72 and 73 drop below 0.5 oz/s at approximately 5 seconds, at which point there is less than 1 oz of liquid remaining in the can, while curve 74 drops below 0.5 oz at approximately 6 seconds, and curve 71 drops below 0.5 oz at approximately 8 seconds. Therefore, approximately the first 11 oz of liquid in cans having the lift-and-twist scores (curves 72 and 73) can be poured out 1 second faster than the conventional LOE score with a conventional venting structure (curve 74) and 3 seconds faster than the conventional LOE score alone (curve 71).

The two lift-and-twist score embodiments 30*a* and 30*c* depicted in FIGS. 5A and 5B were also tested for score performance. The first set of tests evaluated the break force and the tear force for each score design, using a score 30*a* or 30*c* residual of approximately 0.003 inches. Five cans of each score design were used for each test. The break force is the force required to open the part of the main score 31*a* or 31*c* near the rivet 56, before the check slot 35, to allow for initial venting of the beverage can. The tear force is the force required to propagate the opening of the main score 31*a* or 31*c* to the intermediate point 36*a* or 36*c*, thereby creating the main opening 28. For each can tested, the main score 31*a* or 31*c* residual was approximately the same as the score extension 32*a* or 32*c* residual, within a tolerance of ±0.0002 inches.

The average break force for the first embodiment score 30*a* was 3.2 lbs, and the average break force for the third embodiment score 30*c* was 3.7 lbs, both of which are sufficiently low for a user to be able to comfortably perform initial opening (typically, a value under 4.5 lbs is acceptable). The average tear force for the first embodiment score 30*a* was 3.8 lbs, and the average tear force for the third embodiment score 30*c* was 3.7 lbs, both of which are sufficiently low for a user to be able to comfortably propagate the opening of the main score 31*a* or 31*c* and create the main opening 28 (typically, a value under 5.5 lbs is acceptable).

The second set of tests evaluated the burst strength of each score design (this is a "loose buckle" test). Five cans of each score design were pressurized until part of the beverage can failed. The average pressure at which can ends including the first embodiment score 30*a* failed was 73.2 psi, and the average pressure at which can ends including the third embodiment score 30*c* failed was 68.1 psi. For pasteurized products such as beer, it is preferable that a can end withstand an internal pressure of 80 psi. In order to improve the burst strength, the inventors surmise that it would be beneficial to modify the design of the first embodiment score 30*a* and/or the third embodiment score 30*c* using one or more of the score-strengthening mechanisms discussed above.

All of the can ends in the second set of tests suffered "score burst," rather than "peaking" of the can end. This means that the scores score 30*a* or 30*c* failed (score burst) before countersink 24 inverted at a point that forms a peak (that is, peaking). Peaking is a more desirable can end failure mode than score burst, so in order to change the failure mode from score burst to peaking, the inventors surmise that is may be beneficial to modify the design of the first embodiment score 30*a* and/or the third embodiment score 30*c* using one or more of the score-strengthening mechanisms discussed above.

A third set of tests evaluated the burst strength of three modifications of the first embodiment score 30*a* depicted. The three modifications included score 30 residuals of approximately 0.003 inches, 0.004 inches, and 0.005 inches, respectively. Ten cans of each modification were pressurized until part of the beverage can failed and began to reduce the pressure inside of each can. The average pressure at which can ends of each respective modification failed was 87.9 psi, 96.3 psi, and 95.9 psi for respective score 30*f* residuals of approximately 0.003 inches, 0.004 inches, and 0.005 inches. Given that for pasteurized products such as beer, it is preferable that a can end withstand an internal pressure of 80 psi, each of these modifications of the score performed sufficiently.

Regarding the failure mode of each modification, with the first modification having a score 30*a* residual of approximately 0.003 inches, eight can ends suffered "score burst," and two can ends suffered "peaking and leaking" of the can end (that is, leaking from the peak formed upon failure).

Regarding the second and third modifications having the score 30*a* residuals of approximately 0.004 and 0.005 inches, respectively, eight can ends of each modification suffered "peaking" of the can end (i.e., having the can end 14*a* invert or pop up, moving about a hinge approximately located at the peripheral curl 20), and two can ends of each modification suffered "peaking and leaking" Conventional large opening ends such as the can end 3 depicted in FIG. 1A typically have the same rate of peaking and leaking as the second and third modifications, so there is little significant burst strength performance loss in these can ends compared to conventional large opening ends.

Figure 7A:
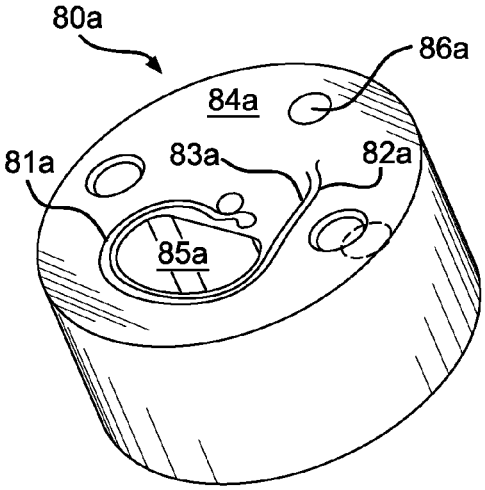
FIG. 7A is a perspective view of an upper score cap suitable for use to form the first embodiment scores depicted in FIG. 5A.
Figure 7B:
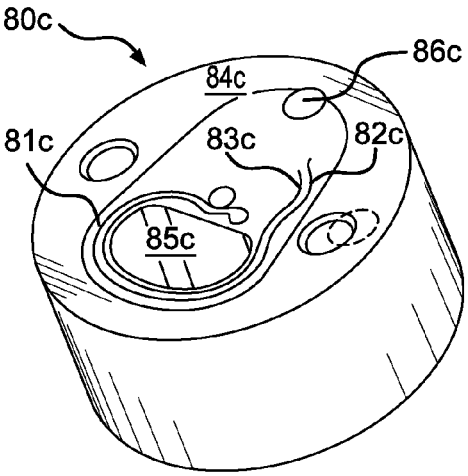
FIG. 7B is a perspective view of an upper score cap suitable for use to form the third embodiment scores depicted in FIG. 5B.
Figure 8:
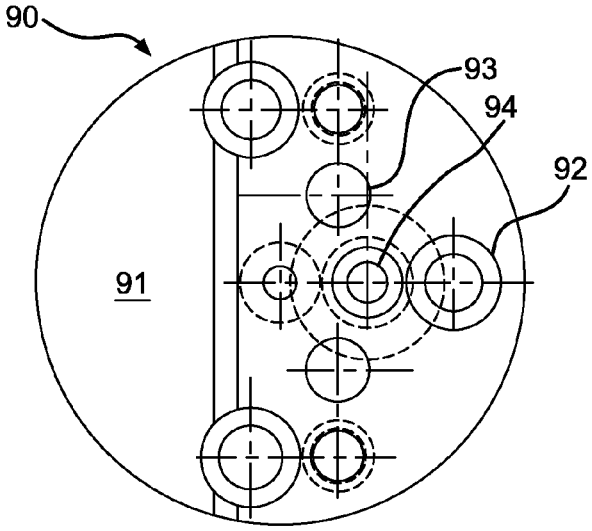
FIG. 8 is a top view of a lower score cap suitable for use to form the first or third embodiment scores depicted in FIGS. 5A and 5B.

Referring to FIGS. 7A, 7B, and 8, an upper score cap 80*a*, suitable for use to form the first embodiment scores depicted in FIGS. 2 and 5A, includes a main score protrusion 81*a*, a score extension protrusion 82*a*, and an anti-fracture score protrusion 83*a*, each of which extends from an anvil surface 84*a*. The upper score cap 80*a* further defines a tear panel aperture 85*a* and a tool attachment aperture 86*a* that penetrates through the upper score cap 80*a* approximately perpendicularly to anvil surface 84*a*.

An upper score cap 80*c*, suitable for use to form the third embodiment scores depicted in FIG. 5B, includes a main score protrusion 81*c*, a score extension protrusion 82*c*, and an anti-fracture score protrusion 83*c*, each of which extends from an anvil surface 84*c*. The upper score cap 80*c* further defines a tear panel aperture 85*c* and tool attachment apertures 86*c* that penetrate through upper score cap 80*c* approximately perpendicularly to anvil surface 84*c*. A score cap (not shown in the figures) for the second embodiment score 30*b* would have the corresponding shape of score 30*b* located in the place on the cap similar to that shown in FIGS. 7A and 7B.

A lower score cap 90, suitable for use to form either of the first or third embodiment scores depicted in FIGS. 5A and 5B, includes an anvil surface 91 that defines a plurality of tool attachment apertures 92 that penetrate through the lower score cap 90 approximately perpendicularly to anvil surface 91.

The lower score cap 90 defines a location 93, at which an aperture is located in a conventional lower score cap, but at which there is no aperture present in the lower score cap 90, because the score extension protrusion 82*a* or 82*c* need to mate with a flat portion of anvil surface 91 to properly form the respective first or third embodiment score extension 30. To compensate for the absence of an aperture at location 93, the lower score cap 90 includes an enlarged aperture at a location 94 (compared to a smaller aperture at location 94 in a conventional lower score cap), so that lower score cap 90 can be securely coupled to and/or removed from other components of can end score forming equipment.

The score extensions of the lift-and-twist embodiments of the can ends shown in the Figures may only require relatively minor modifications to existing shell press and conversion tooling, such as the modifications to the locations of the apertures 92 in the lower score cap 90, to allow conventional shell press and conversion tooling to be used to produce the lift-and-twist embodiments of the can ends.

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Further, several advantages have been described that flow from the structure and methods; the present invention is not limited to structure and methods that encompass any or all of these advantages. Those skilled in can end technology, having the benefit of the teachings of this specification, may effect numerous modifications to the invention as described herein, and changes can be made without departing from the scope and spirit of the invention as defined by the appended claims. Furthermore, any features of one described embodiment can be applicable to the other embodiments described herein. For example, any features or advantages related to the shape of the main score, score extension, and anti-fracture score with respect to discussion of a particular can end embodiment can be applicable to any of the other can end embodiments described herein.

What is claimed:

1. A beverage can end for seaming onto a can body, the can end comprising: a peripheral wall;

a center panel;

a tab attached to the center panel by a rivet;

a tear panel including (i) a main portion capable of pivoting about a hinge and (ii) a vent portion;

a main reference line that bisects the tear panel main portion and extends through the rivet, the hinge being offset relative to the main reference line;

a transverse reference line that is perpendicular to the main reference line and bisects the rivet, the main portion of the tear panel being located in front of the transverse reference line; and a score including an arcuate main score that defines the main portion of the tear panel and a score extension that defines the vent portion, a first end of the score (i) defines one end of the hinge and (ii) is located on the hinge-side of the main reference line and in front of the transverse reference line, a second end of the score (i) defines one end of the score extension and (ii) is located on the hinge-side of the main reference line and to the rear of the transverse reference line;

whereby the score is configured such that actuation of the tab from a horizontal rest position to an intermediate position ruptures the main score portion to pivot the tear panel main portion about the hinge and further actuation of the tab by twisting from the intermediate position ruptures the score extension.

2. The beverage can end of claim 1, whereby the score extension defines an arc that corresponds to the path of the tab when twisted in the further actuation from the intermediate position.

3. The beverage can end of claim 1, wherein the score is configured such that the actuation from the intermediate position is optional.

4. The beverage can end of claim 1, wherein the main portion of the tear panel is elongated in a transverse direction.

5. The beverage can end of claim 4, wherein the main portion of the tear panel has an aspect ratio of between 1.3 and 1.7.

6. The beverage can end of claim 1, wherein the main reference line and the transverse reference line divide the center panel into first and second front quadrants and first and second rear quadrants, the score extending (i) from the first end of the score in the first front quadrant across to the main reference line near the rivet to extend into the second front quadrant, (ii) in an arcuate path in the second front quadrant, (iii) across the main reference line near the frontmost portion of the center panel, (iv) in an arcuate path in the first front quadrant, (v) to an intermediate point located in the first front quadrant and defining an end of the hinge opposite the first end of the score.

7. The beverage can end of claim 6, wherein the score extension extends from the intermediate point across the transverse reference line into the first rear quadrant.

8. The beverage can end of claim 1, wherein the hinge is defined between the first end of the score and an intermediate point on the score at a base of the score extension.

9. The beverage can end of claim 8, wherein the score extension is no longer than three times a length of the hinge.

10. The beverage can end of claim 8, wherein the score extension is no longer than two times the hinge.

11. The beverage can end of claim 1, wherein the one end of the score extension is spaced apart from the main score.

* * * * *